United States Patent [19]

Kozuka et al.

[11] Patent Number: 4,989,622

[45] Date of Patent: Feb. 5, 1991

[54] VANITY CASE

[75] Inventors: Shinichi Kozuka, Tokyo; Yukitomo Yuhara, Abiko, both of Japan

[73] Assignee: Yoshida Industry Co., Ltd., Tokyo, Japan

[21] Appl. No.: 215,754

[22] Filed: Jul. 6, 1988

[30] Foreign Application Priority Data

| | | | |
|---|---|---|---|
| Feb. 1, 1988 | [JP] | Japan | 63-11199 |
| Feb. 4, 1988 | [JP] | Japan | 63-13035 |
| Feb. 4, 1988 | [JP] | Japan | 63-13036 |
| Mar. 17, 1988 | [JP] | Japan | 63-34542 |
| Apr. 8, 1988 | [JP] | Japan | 63-46898 |
| May 20, 1988 | [JP] | Japan | 63-65747 |

[51] Int. Cl.[5] ..... A45D 42/02

[52] U.S. Cl. ..... 132/301; 132/293

[58] Field of Search ..... 132/286, 293, 294, 301, 132/291; 206/823

[56] References Cited

U.S. PATENT DOCUMENTS

| | | | |
|---|---|---|---|
| 4,276,893 | 7/1981 | Enomoto et al. | 132/301 |
| 4,331,168 | 5/1982 | Hatakeyama | 132/316 |
| 4,366,829 | 1/1983 | Yuhara | 132/301 |
| 4,399,826 | 8/1983 | Ogasawara | 132/301 |
| 4,474,196 | 10/1984 | Yuhara | 132/301 |
| 4,483,355 | 11/1984 | Yuhara | 132/301 |
| 4,595,028 | 6/1986 | Yuhara | 132/314 |
| 4,679,576 | 7/1987 | Yuhara et al. | 132/293 |
| 4,683,899 | 8/1987 | Yuhara et al. | 132/293 |
| 4,696,317 | 9/1987 | Shioi et al. | 132/314 |

FOREIGN PATENT DOCUMENTS 61-143502 7/1986 Japan .

*Primary Examiner*—Gene Mancene
*Assistant Examiner*—Michael Lynch
*Attorney, Agent, or Firm*—Wenderoth, Lind & Ponack

[57] ABSTRACT

In a vanity case including a receptacle, a cover hinged with the receptacle and latch members for maintaining the cover in a closed position, a push piece is provided which is slidably movable along the longitudinal direction of the vanity case. The push piece has a center opening and an arm swingably connected to a rear wall defining the center opening, the arm having a portion extending forwardly from the rear wall and adjacent at least one of the receptacle and cover in the closed position. A stationary abutment is provided for, upon rearward movement of the push piece, abutting against the arm and causing it to swing relative to the rear wall with the front portion of the arm moving in the center opening, thereby forcing the receptacle and cover away from each other.

29 Claims, 11 Drawing Sheets

VANITY CASE

BACKGROUND OF THE INVENTION

1. Field of the Invention

The present invention relates to a vanity case of the type in which a receptacle member and a cover member are hinged together at respective rear ends and the cover member is maintained in a closed position with respect to the receptacle member by engagement of latch means formed on the front ends of both members.

2. Description of the Prior Art

Various attempts and efforts have hitherto been made in order to facilitate an opening operation of the cover member, and a push piece has been proposed and found effective. For example, U.S. Pat. No. 4,276,893 discloses such a push piece which is slidably arranged in a recess formed in a marginal portion of the receptacle member. The push piece includes an enlarged head to provide an inclined surface which, upon inward movement of the push piece, acts on a nose of the cover and forces the latter upwardly to thereby release the engagement of latch means. U.S. Pat. No. 4,366,829 also discloses a similar push piece having an elastic member for urging it outwardly. In these vanity cases, however, the force acting on the nose is in a direction perpendicular to the inclined surface and therefore includes a force component in a horizontal direction, which component tends to urge the nose toward the inner wall of the recess where one of the latch means is formed. It would be thus understood that a user has to press the push piece with a relatively large force in order to open the cover since the horizontal force component tends to strengthen the engagement between the latch means. This is not desirable in view of the nature of the vanity case.

U.S. Pat. No. 4,387,730, discloses another type of push piece in which one of the latch means is formed on the push piece so that the inward movement of the latter separates its latch from the other, stationary latch to release the engagement. Further inward movement of the push piece causes an inclined surface thereof to force up the cover. An enlarged head for providing the inclined surface renders the entire push piece thick and bulky.

Also, U.S. Pat. No. 4,399,826 teaches an L-shaped push piece which is pivotally secured to the receptacle in such a manner that one end of the push piece acts on the nose to force up the cover when the push piece is rotated. The rotation is caused only by pressing a lower portion remote from the pivot of the other end of the push piece, which requires a somewhat delicate operation.

Further, U.S. Pat. Nos. 4,679,576 and 4,683,899 disclose a push piece having a front wall and an arm integrally formed with the front wall through a thin flexible section which permits the arm to swing relative to the front wall. The arm, upon inward movement of the push piece, acts on the nose to force the cover in upward and forward directions. The recess, however, should have a dimension sufficiently large to permit the sliding movement of the front wall and the swinging motion of the arm.

Thus, all of the prior art, vanity cases are still unsatisfactory with regard to handling ability and/or the size for the push piece, and it is therefore an object of the invention to provide a vanity case having an improved operability with a reduced space for a push piece.

SUMMARY OF THE INVENTION

According to the invention, a vanity case comprises a receptacle member, a cover member hinged with the receptacle member at the rear end thereof, latch means for maintaining the cover member in a closed position with respect to the receptacle member, a push piece and stationary abutment means. The push piece has formed therein a center opening and an arm swingably connected to the rear wall defining the center opening, and is slidably movable along the longitudinal direction of the vanity case. The arm has a portion extending forwardly from the rear wall and adjacent at least one of the receptacle and cover members in the closed position of the cover member. The stationary abutment means is arranged to, upon rearward movement of the push piece, abut against the arm and cause the arm to swing relative to the rear wall with the front portion of the arm moving in the center opening, thereby forcing the receptacle and cover members away from each other.

Other objects, features and advantages of the invention will be apparent from the following detailed description thereof when taken in conjunction with the accompanying drawings.

DETAILED DESCRIPTION OF THE INVENTION

Figure 1:
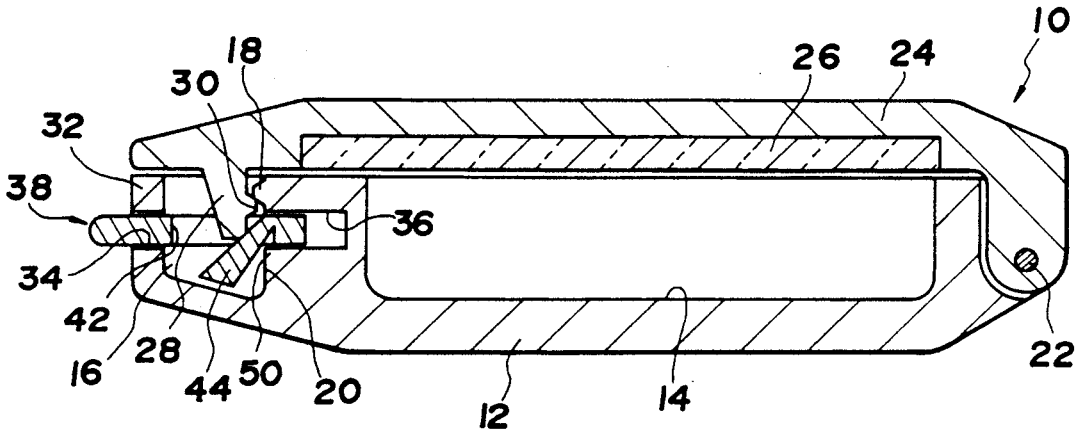
FIG. 1 is a longitudinally sectioned view of a vanity case according to an embodiment of the invention.

Referring first to FIGS. 1 to 4 of the drawings, a vanity case 10 includes a receptacle member 12 having a concave portion 14 formed on the upper surface of the receptacle for containing cosmetic material. The front marginal portion of the receptacle 12 is centrally provided with a box-like recess 16 which opens in an upward direction. A first latch tongue 18 is formed on an inner vertical surface 20 defining the recess 16. The receptacle 12 is hinged at its rear end and by means of a pin 22 with a cover member 24 which has a mirror 26 attached thereto. A nose 28 extends downwardly from the cover 24 at a position corresponding to the recess 16, and a second latch tongue 30 is formed on the nose 28 to face the first one 18. The arrangements are such that when the cover 24 is closed over the receptacle 12, the latch tongues 18 and 30 engage with each other to thereby maintain the cover 24 in the closed position.

Figure 2:
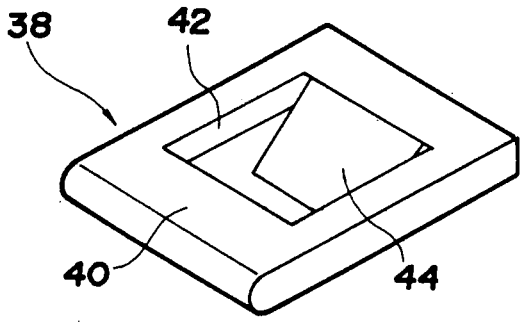
FIG. 2 is an enlarged perspective view showing a push piece of the vanity case in FIG. 1.
Figure 3:
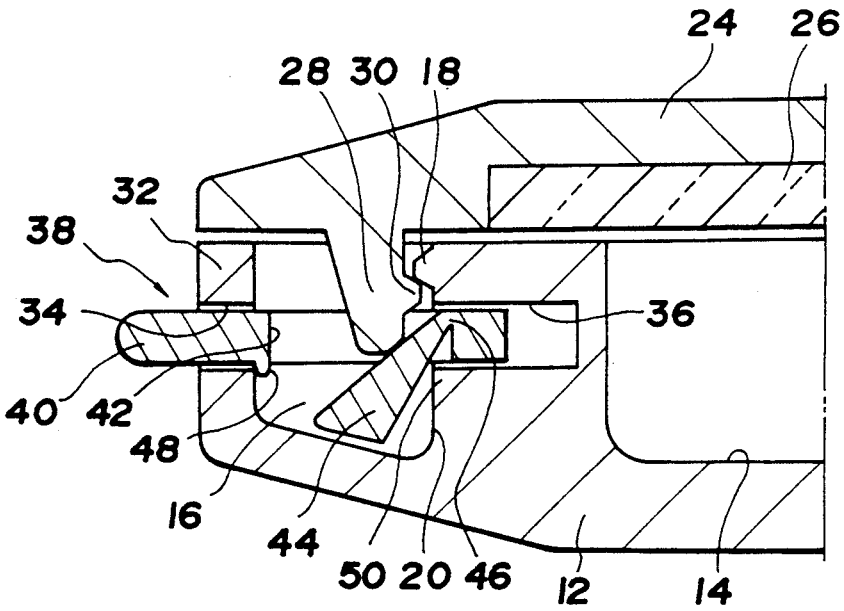
FIG. 3 is an enlarged fragmentary view of the vanity case.

The front wall 32 defining the recess 16 is drilled or otherwise formed to have a hole 34 that is aligned with a slit 36 extending rearwardly from the inner wall 20 of the recess 16. Slidably fitted through the hole 34 is a plate-like body 40 of a push piece 38 which extends across the recess 16 and is also slidably fitted in the slit 36. As shown in FIG. 2, the push piece 38 comprises the body 40 having a center opening 42 formed therethrough, and an arm 44 which is connected at one end thereof to the rear surface defining the opening 42 at a connected section 46 in such a manner that the arm 44 may be swingable relative to the body 40 in a direction toward and away from the opening 42 and that the arm normally extends forwardly and downwardly. In the illustrated embodiment, the push piece 38 is integrally molded of synthetic resin material having the property of flexibility, and the connecting section 46 is formed thin to permit the swinging motion of the arm 44 relative to body 40.

In assembly, the push piece 38 is inserted through the hole 34 with the arm 44 being manually held within the opening 42, and is secured to the receptacle 12 by a projection or a stopper 48 formed on the lower surface of the body 40 adjacent the front of opening 42. When the cover 24 is in the closed position of FIG. 3, the stopper 48 engages with the inner surface of front wall 32 to project the front end of the body 40 beyond the wall 32. A lower portion of the nose 28 is positioned within the opening 42 and its lower inner end is in contact with the upper surface of the arm 44. The lower surface of the arm 44 is close to a corner 50 defined between the slit 36 and the vertical surface 20.

Figure 4:
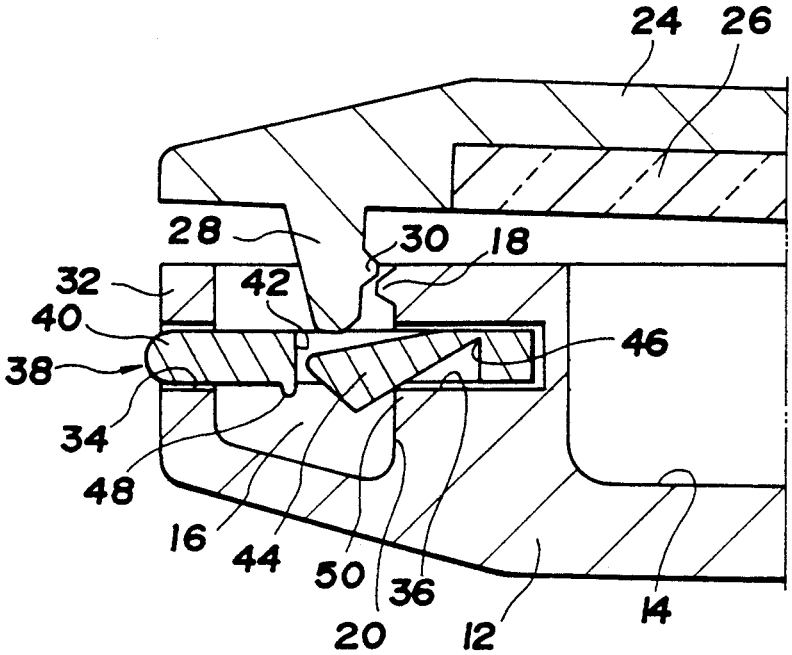
FIG. 4 is a view similar to FIG. 3 showing an operation of the push piece.

In order to open the cover 24, the front end of the body 40 is pushed inwardly. As the body 40 moves inward, the lower surface of arm 44 abuts against the corner 50 and is raised toward the opening 42. With this swinging motion, the arm upper surface presses the lower inner end of the nose 28 upwardly and forwardly to thereby release the engagement between the first and second latch tongues 18 and 30, as shown in FIG. 4. Because the forwardly directed pressure to the nose 28 weakens such engagement, the latch release operation can be made with a small force. Upon removal of the force applied to the body 40, the push piece 38 returns to its normal position due to a resilient force exerted in the section 46.

It should be noted here that the push piece may be mounted on the cover 24, and one might imagine such arrangements by viewing the figures upside down. Also, it is not essentially necessary that the nose 28 enter into the opening 42 in the closed position of the cover. The lower end of the nose may assume a position above the opening and the arm may swing until its upper surface comes to a level above the opening. A bulged lower surface of the arm will enable such a large stroke of swinging motion. Further, the arm lower surface may abut against any portion other than the corner 50. For example, such corner may be chamfered and provided with a projection extending toward the arm for contact therewith.

Figure 5:
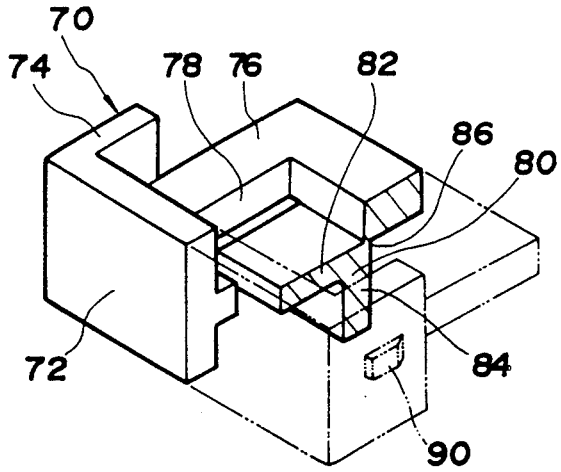
FIG. 5 is an enlarged partly sectioned perspective view illustrating a push piece according to another embodiment of the invention.

FIG. 5 illustrates a push piece 70 according to another embodiment of the invention, which includes a front wall 72 and side walls 74—74 defining a U-shape in plan view. A plate-like body 76 extends rearwardly from a vertical center of the front wall 72 and is formed with an opening 78 below which an arm 80 is arranged. This arm 80 is of an inverted L-shape comprising a horizontal portion 82 and a vertical portion 84 joined together at a corner 86 at which the arm 80 is integrally and swingably connected to the rear surface defining the opening 78 such that the upper surface of horizontal portion 82 normally extends substantially along the lower end of the opening 78.

Figure 6:
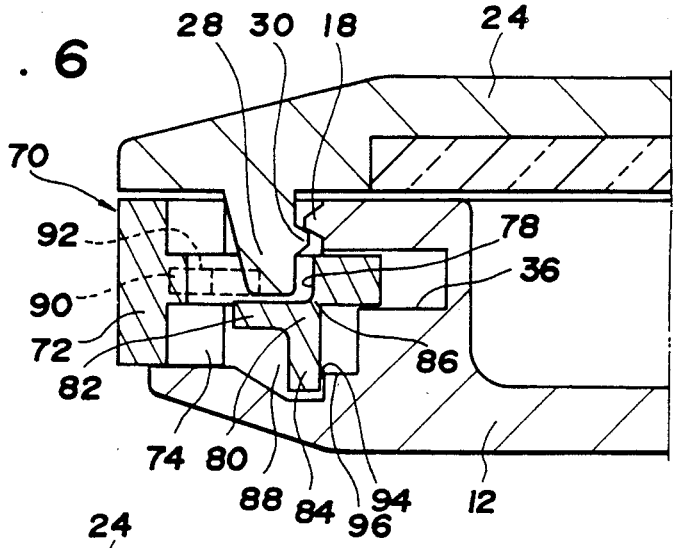
FIG. 6 is a fragmentary sectional view of a vanity case incorporating the push piece of FIG. 5.

The push piece 70 is mounted in an upwardly and forwardly opened recess 88 of the receptacle 12 with the rear end of body 76 being loosely fitted in the slit 36. Provided on the side walls 74 are projections 90 which are fitted in grooves 92 on the side surfaces defining the recess 88 in such a manner as to permit sliding movement of the push piece 70. When the cover 24 is maintained in the closed position as shown in FIG. 6, the arm horizontal portion 82 is close to the lower end of the nose 28 extending into the opening 78 while the vertical portion 84 is at its lower portion closely adjacent a corner 94 that is provided by a step 96 on the inner surface 20.

Figure 7:
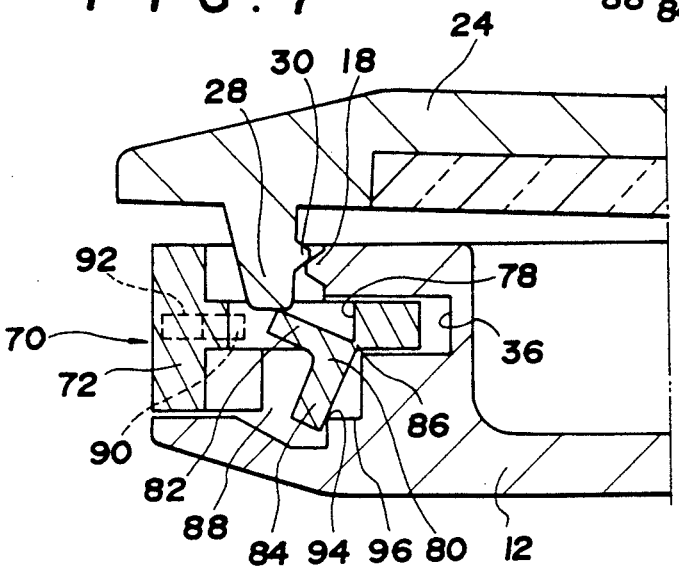
FIG. 7 is a similar view showing an operation of the push piece.

By pushing the front wall 72 inwardly, the push piece 70 moves while being guided by the grooves 92 and slit 36. This movement causes the vertical portion 84 to abut against the corner 92, followed by swinging or tilting of the arm 80 relative to the body 76. Therefore, the horizontal portion 82 presses the nose 28 upwardly to release the engagement between the latch tongues 18 and 30, as seen from FIG. 7.

In the present invention one of the latch tongues may be formed on the push piece, and several examples are illustrated in the drawings.

Figure 8:
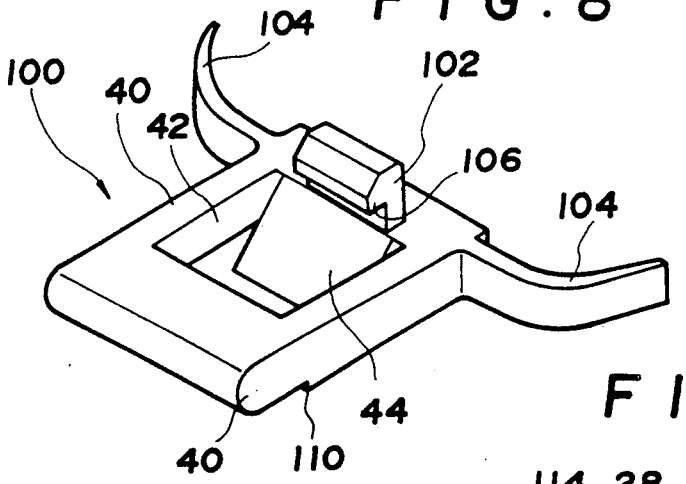
FIG. 8 is a perspective view of a push piece according to another embodiment of the invention.
Figure 9:
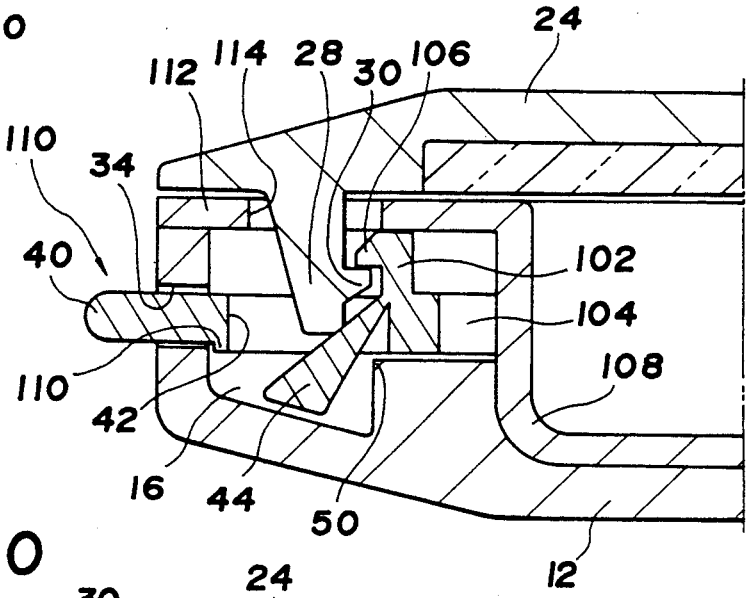
FIGS. 9 and 10 are fragmentary sectional views of a vanity case having the push piece of FIG. 8.

A push piece 100 in FIG. 8 is similar to that of FIG. 2 except that it has a pawl 102 extending upwardly from the body 40 at a position adjacent the rear end of the opening 42 and that a pair of resilient wings 104 extend from the rear side surfaces of the body 40 to project outwardly and rearwardly. When the push piece 100 is mounted in the recess 16 of the receptacle 12, the rear ends of wings 104 abut against a wall of a tray 108, which also defines the recess 16, to urge the body 40 forwardly where a first latch tongue 106 formed on the pawl 102 engages with the second tongue 30 to keep the cover 24 in the closed position of FIG. 9. A step 110 is formed on the lower surface of body 40 to restrain the forward displacement of the push piece 100. The tray 108 has a front margin 112 which conceals the recess 16 and has a through-hole 114 to permit the nose 28 to enter into the recess 16.

Figure 10:
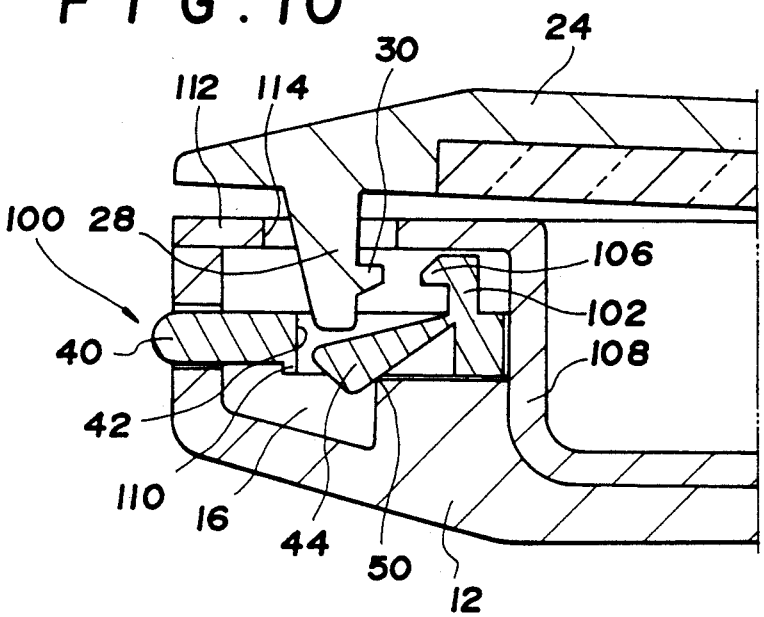

An inwardly directed pressure applied to the front end of body 40 causes the push piece 100 to retract against the resilient force of wings 104, resulting in the first latch tongue 106 separating from the second one 30 to release the engagement. At the same time, the arm 44 is raised into the opening 42 and presses the nose 28 upwardly so that the cover 24 lifts up sufficiently for a subsequent manual opening operation (FIG. 10). If desired, the arm 44 may normally abut against the corner 50 so that, upon inward movement of the push piece 100, the arm presses the nose 28 before the engagement of latch tongues is released. Such an arrangement makes it possible to open the cover 24 to a larger angle as the second latch tongue 30 is disengaged from the first one 18 by a snap action.

Figure 11:
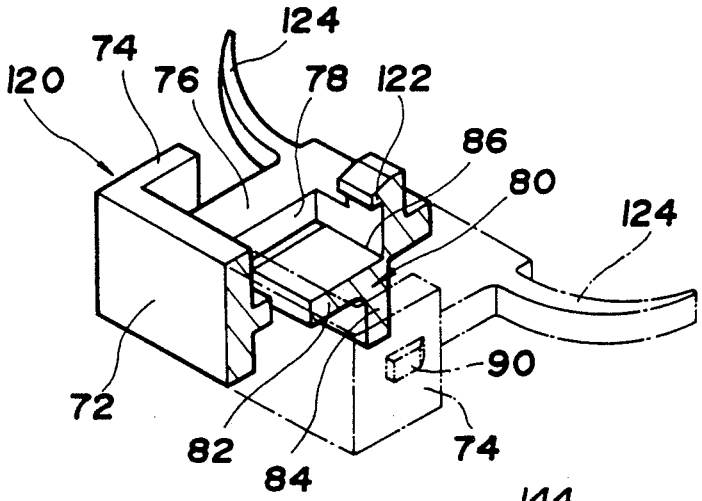
FIG. 11 is a partly sectioned perspective view of a push piece according to another embodiment of the invention.

FIG. 11 shows a push piece 120 which is similar to the push piece 70 of FIG. 5 but includes a first latch tongue 122 and resilient wings 124 as in the example just described above. The operation of this push piece 120 will be apparent from FIGS. 6, 7, 9 and 10, and further description is therefore omitted.

Figure 12:
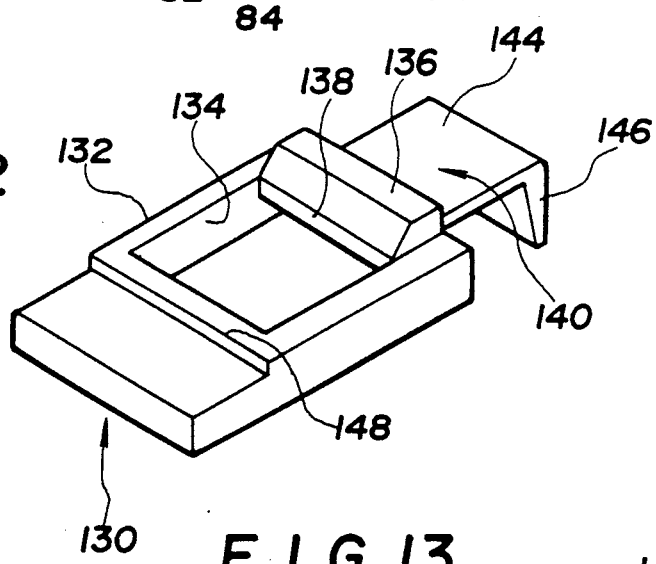
FIGS. 12 and 13 are a perspective view and a longitudinally sectioned view, respectively, of a push piece according to another embodiment of the invention, in the form as molded.
Figure 13:
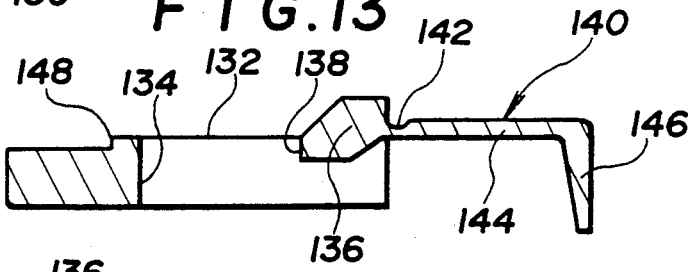
Figure 14:
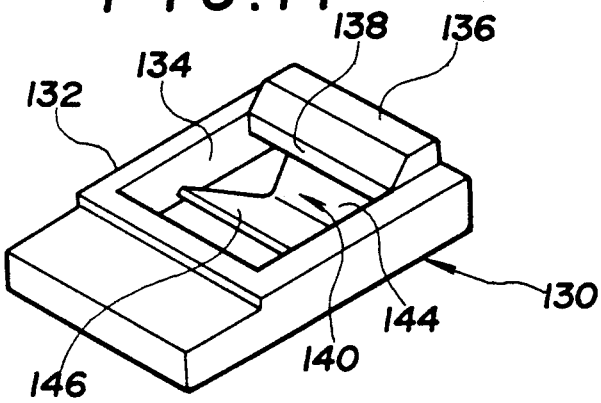
FIG. 14 is a perspective view of the push piece of FIGS. 12 and 13 in the form ready for assembly.

A push piece 130 in FIG. 12 comprises a plate-like body 132 having a U-shape in plan view to define an opening 134, a cross bar 136 extending between the rear ends of arms of the body 132 and having a first latch tongue 138 at its front surface, and an arm 140 integral with the bar 138 through a thin flexible section 142 and having a base portion 144 and a hook portion 146 which is bent substantially at a right angle relative to the base portion 144. This push piece is integrally molded in the shape shown in FIGS. 12 and 13 wherein the base portion 144 of arm 140 extends rearwardly parallel with the body 132 and the hook portion 146 extends downwardly. Before assembly, the arm 140 is folded at 142 so that the base portion 144 extends forwardly and downwardly to position the end of hook portion 146 within the opening 134, as illustrated in FIG. 14. When the push piece 130 is mounted in the recess 16 of the receptacle 12, the arm base portion 144 abuts against the corner 50 and urges the push piece 130 forwardly to engage a step 148 on the body 132 with the front wall 32 defining the recess 16.

Figure 15:
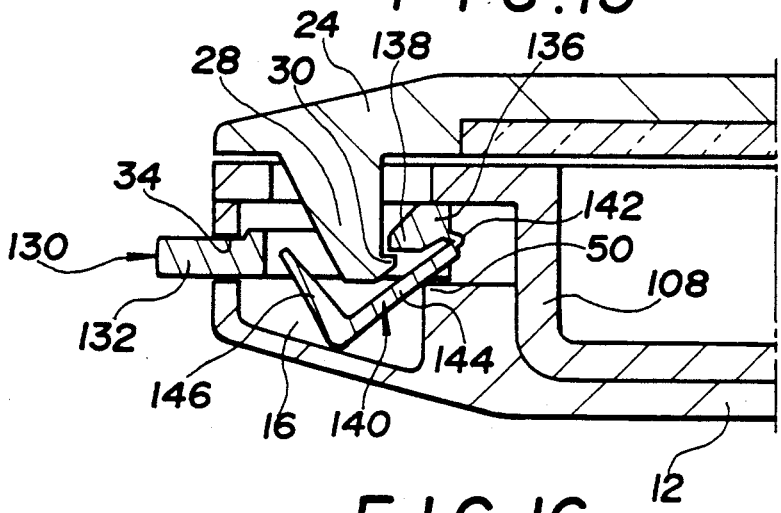
FIG. 15 is a fragmentary section of a vanity case incorporating the push piece of FIG. 14.
Figure 16:
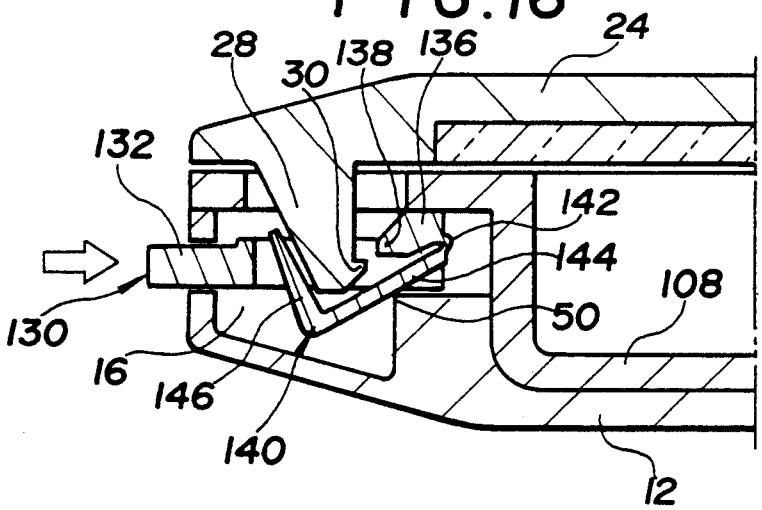
FIGS. 16 and 17 are views similar to FIG. 15 showing an operation of the push piece.
Figure 17:
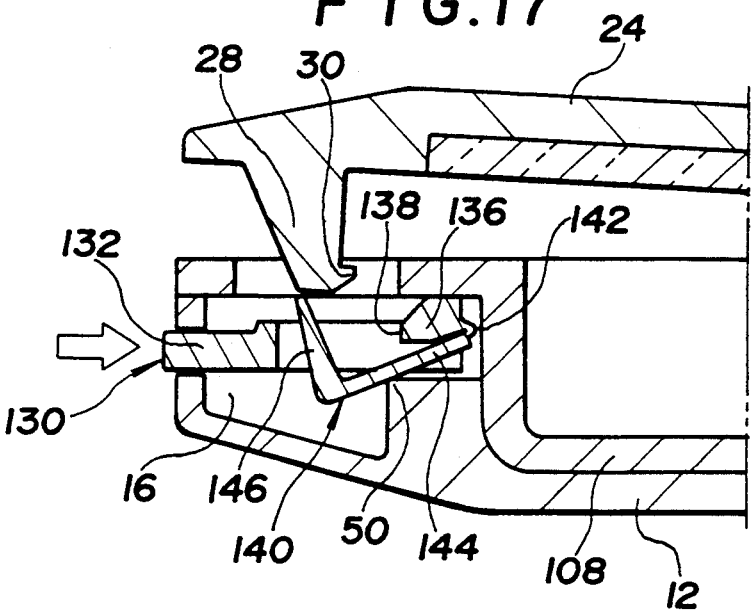

The cover 24 is maintained in the closed position by engagement of its latch tongue 30 with the first latch tongue 138 of the push piece 130. The arm base portion 144 is below the nose 28 while its hook portion 146 is forward of the nose 28 with a substantial space therebetween (FIG. 15). With these arrangements, when the body 132 is pushed inwardly, the cross bar 136 moves in a direction away from the nose 28 to release the engagement and, at the same time, the corner 50 causes the arm 140 to swing about the section 142 so that the hook portion 146 is close to the lower portion of the nose 28 as seen from FIG. 16. Further inward movement of the push piece 130 results in the hook portion 146 lifting the nose 28 to open the cover 24 (FIG. 17). The push piece 130, upon removal of the pressure, will return to its normal position by a resilient force exerted at the section 142. The return movement may be promoted by providing resilient wings such as 104 in FIG. 8 which wings also can ensure stable engagement of the latch tongues.

Figure 18:
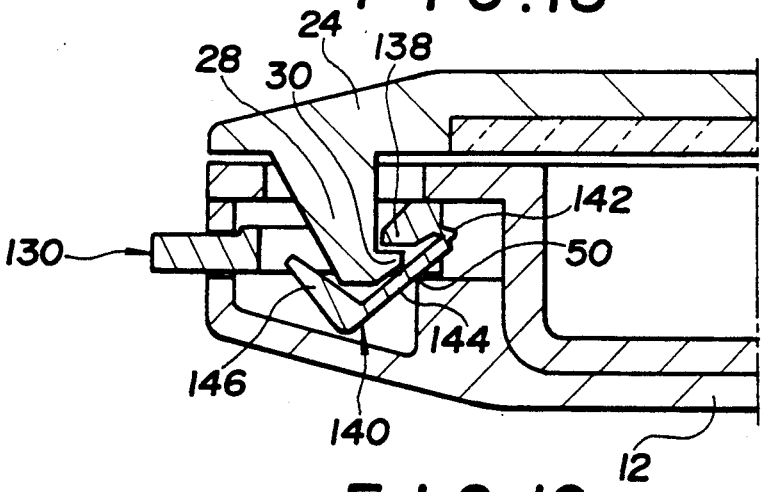
FIGS. 18 and 19 are views similar to FIGS. 15 and 16, respectively, for illustrating a slightly modified example.
Figure 19:
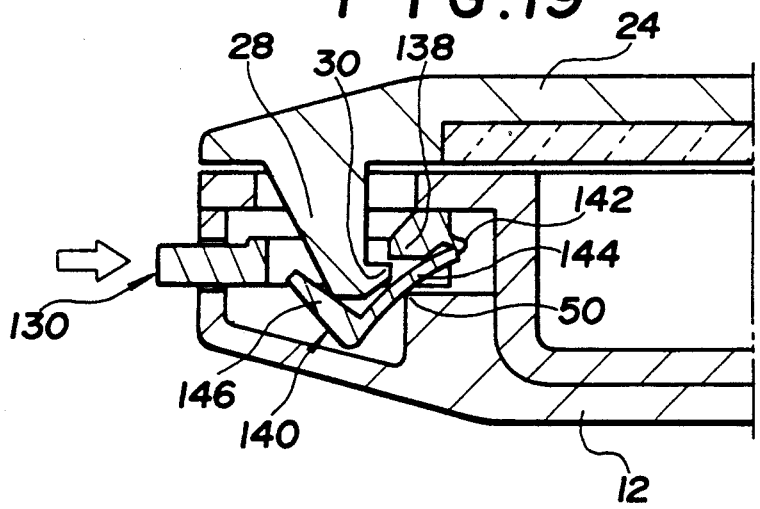

In a slightly modified arrangement of FIGS. 18 and 19, the arm hook portion 146 normally is closely adjacent to the front lower edge of the nose 28 so that, upon inward movement of the push piece 130, the hook portion 146 starts to press the nose 28 upwardly before the engagement is released. This results in an elastic deformation of the arm base portion 144, which will spring the nose 28 upwardly immediately after the first latch tongue 138 is disengaged from the second one 30.

Figure 20:
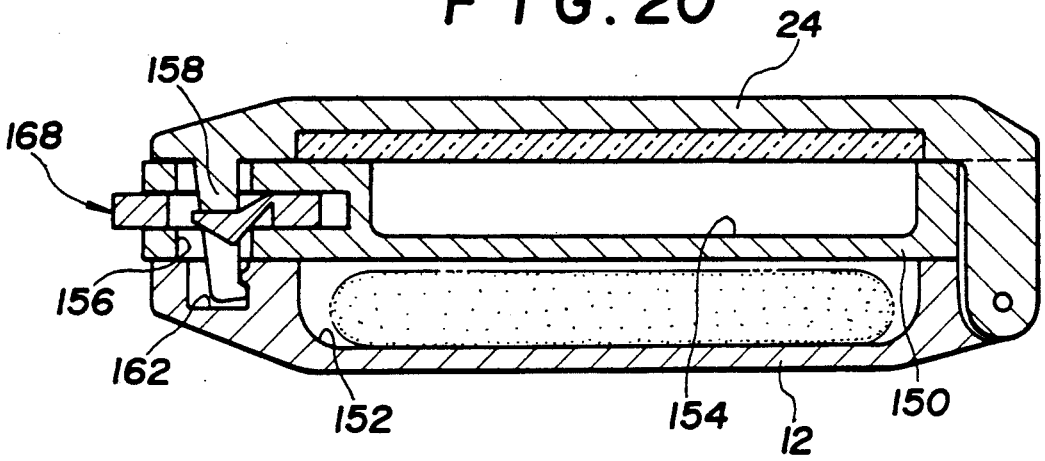
FIG. 20 is a longitudinal section of a vanity case according to another embodiment of the invention.

The present invention is also applicable to a "three parts" vanity case having a tray disposed between the receptacle and cover to provide two chambers for containing cosmetic tools such as a puff along with the cosmetic material. One example thereof is illustrated in FIG. 20 in which a tray 150 as well as the cover 24 is hinged with the receptacle 12 at rear ends thereof. A first chamber 152 is defined in the receptacle 12 to contain a puff while a second chamber 154 is defined in the tray 150 to contain cosmetic material. The front marginal portion of the tray 150 is formed with a through-hole 156 which permits a nose 158 of the cover 24 to extend therethrough into a recess 162 of the receptacle 12 where a second latch tongue 160 on the nose 158 is engaged with a first tongue 164 on the inner wall defining the recess 162.

Figure 21:
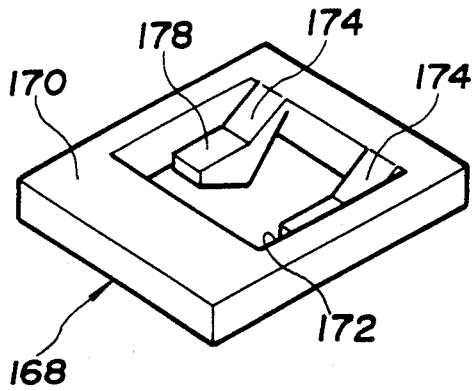
FIG. 21 is an enlarged perspective view of a push piece of the vanity case in FIG. 20.
Figure 22:
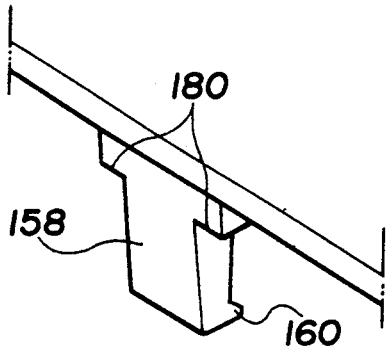
FIG. 22 is a fragmentary perspective view illustrating a nose of the vanity case.
Figure 23:
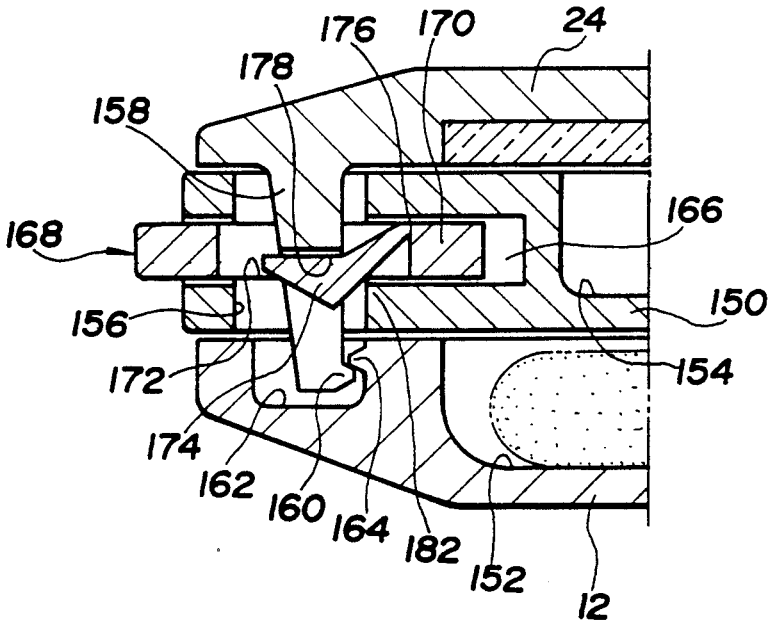
FIG. 23 is an enlarged fragmentary view of the vanity case.

A slit 166 extends from the front edge of the tray 150 to a portion near the second chamber 154, and a push piece 168 is slidably fitted in the slit 166 across the through-hole 156. As best shown in FIG. 21, this push piece 168 comprises a plate-like body 170 having a center opening 172 which is aligned with the through-hole 156, and a pair of spaced arms 174 extending in the opening 172. Each arm 174 is connected to the upper end of the rear wall defining the opening 172 through a thin flexible section 176 that allows swinging movement of the arm 174. Normally, the base portion of the arm 174 extends downwardly and forwardly and its end portion includes a flat surface 178 substantially parallel with the upper surface of the body 170. The nose 158 has shoulders 180 (FIG. 22) to permit the lower portion of nose 158 to pass through a space between the arms 174. Thus, when the cover 24 is closed over the receptacle 12, the flat surfaces 178 of arms 174 abut the shoulders 180. Also, the downwardly inclined lower surfaces of the arms 174 are in contact with a corner 182 defined between the slit 166 and the rear end of the hole 156, as seen from FIG. 23.

Figure 24:
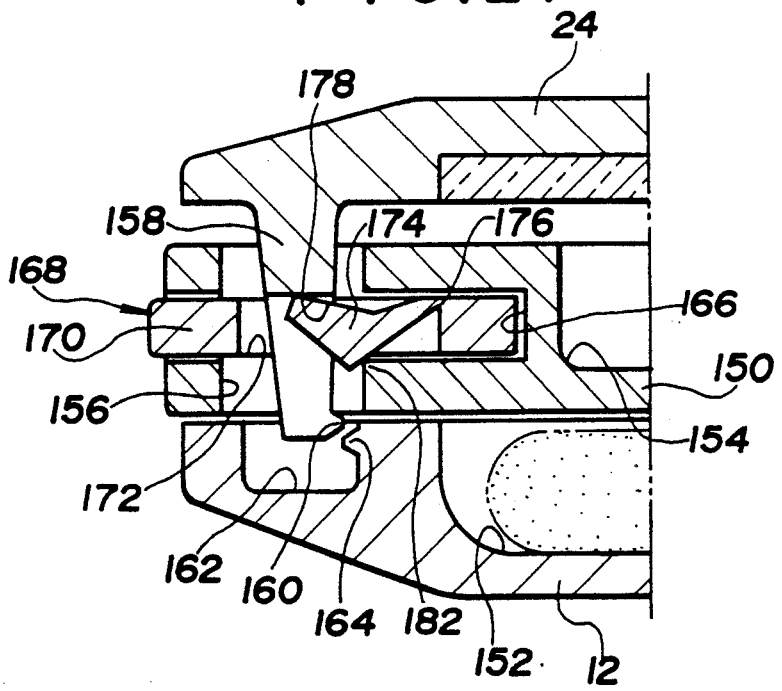
FIG. 24 is a similar view showing an operation of the push piece.

The push piece 168 is slidably moved rearwardly when its front end projecting from the front edge of the tray 150 is pushed. This movement causes the arms 174 to swing upwardly about the sections 176, whereby the flat surfaces 178 press the nose 158 at the shoulders 180 to release the engagement of the latch tongues 160 and 164 (FIG. 24).

Figure 25:
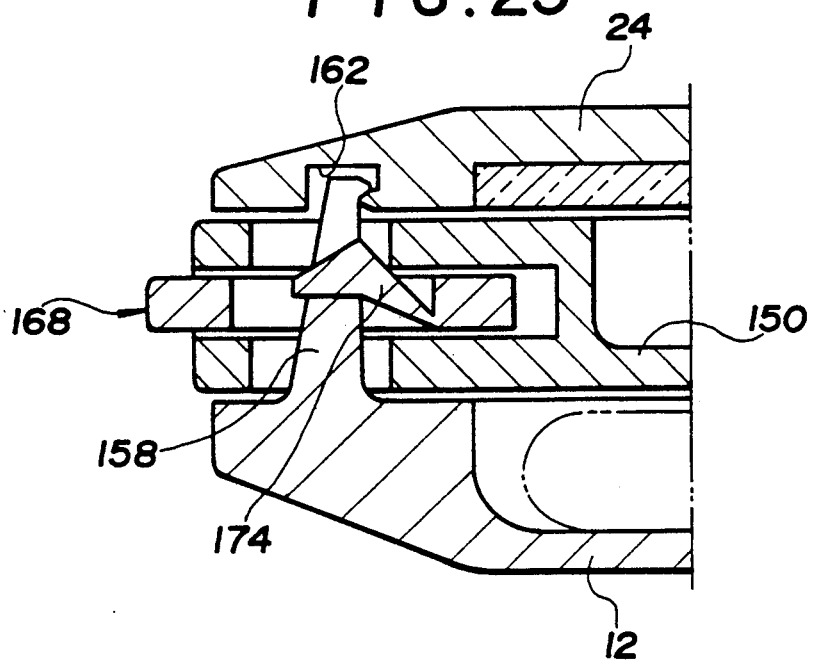
FIG. 25 is also a view similar to FIG. 23 showing a modified, reverse arrangement.

The above arrangements may be reversed, that is, the nose 158 may be provided on the receptacle 12 to extend through the tray 150 into the recess 162 in the cover 24 and the arms 174 may be adapted to press down the nose 158 when the push piece 168 is moved rearwardly. See FIG. 25. Also, the push piece 168 may be provided with resilient wings such as 104 in FIG. 8 to urge the body 170 forwardly.

Figure 27:
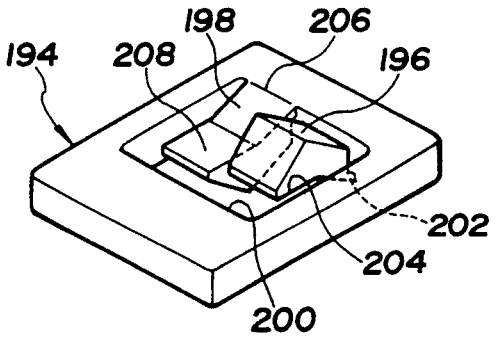
FIG. 27 is a perspective view showing a push piece in FIG. 26.
Figure 28:
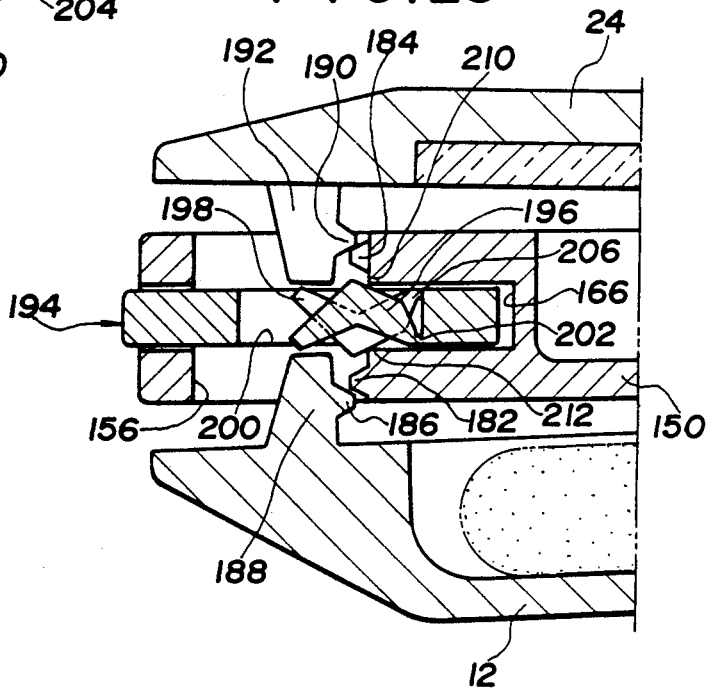
FIG. 28 is a view similar to FIG. 26 showing an operation of the push piece.

In a modified example illustrated in FIGS. 26 through 28, the tray 150 has third and fourth latch tongues 182 and 184 which are formed on the inner surface defining the through-hole 156 at positions above and below the slit 166, respectively, and which are offset relative to each other in the transverse direction. The third latch tongue 182 is arranged to engage with a first tongue 186 that is formed on a first nose 188 extending upward from the receptacle 12 to maintain the tray 150 in the closed position, while the fourth latch tongue 184 is adapted to keep the cover 24 in the closed position through engagement with a second tongue 190 that is formed on a second nose 192 extending downward from the cover 24. A push piece 194 has first and second arms 196 and 198 arranged side by side in a center opening 200 and aligned in opposite directions. Thus, the first arm 196 is connected through a thin section 202 to the lower end of the rear wall and extends upwardly and forwardly to provide a downwardly facing flat surface 204, while the second arm 198 connected at 206 to the upper end of the rear wall extends downwardly and forwardly to provide an upwardly facing flat surface 208.

Figure 26:
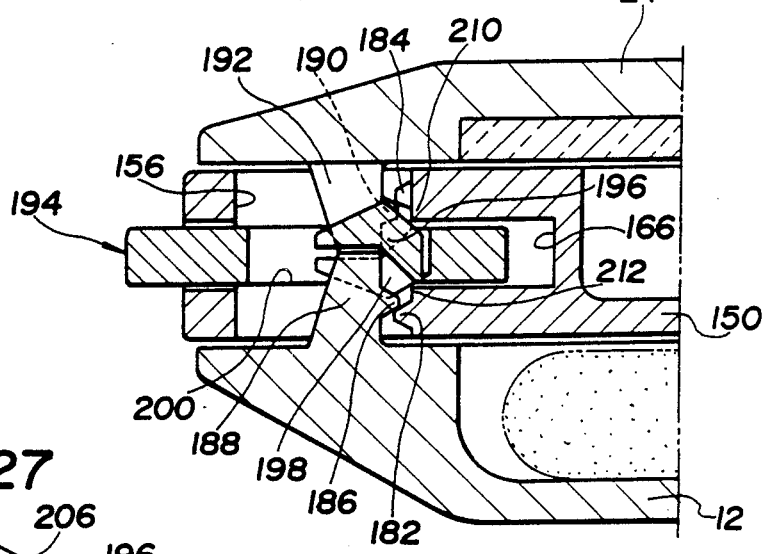
FIG. 26 is a fragmentary sectioned view of a vanity case according to still another embodiment of the invention.

When the vanity case is in the closed position of FIG. 26, the first arm 196 is closely adjacent the upper end of first nose 188 at the flat surface 204 and abuts at the inclined upper surface against a corner 210 defined between the inner surface of the through-hole 156 and the upper surface of the slit 166. Also, the second arm 198 is closely adjacent the lower end of second nose 192 at the flat surface 208 and abuts at the inclined lower surface against a corner 212 between the through-hole 156 and the slit lower surface. An inward movement of the push piece 194 causes the first arm 196 to swing downwardly and the second arm 198 to swing in the opposite direction, whereby the flat surfaces 204 and 208 press the noses 188 and 192 downwardly and upwardly, respectively. Thus, the engagements between 182 and 186 and between 184 and 190 are released simultaneously to open the cover 24 and the tray 150. If desired, engagement release timings may be varied so that the inward movement of the push piece 194 first opens the cover 24 and then the tray 150, or vice versa. This can be achieved by, for example, differentiating longitudinal positions of the corners 210 and 212.

Figure 30:
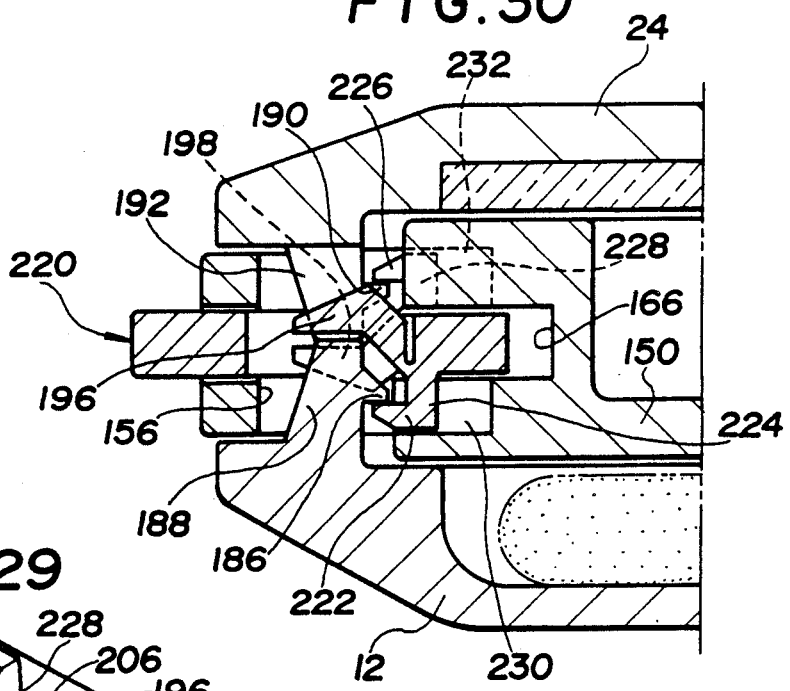
FIGS. 30 and 31 are fragmentary sectioned views of a vanity case incorporating the push piece of FIG. 29.
Figure 29:
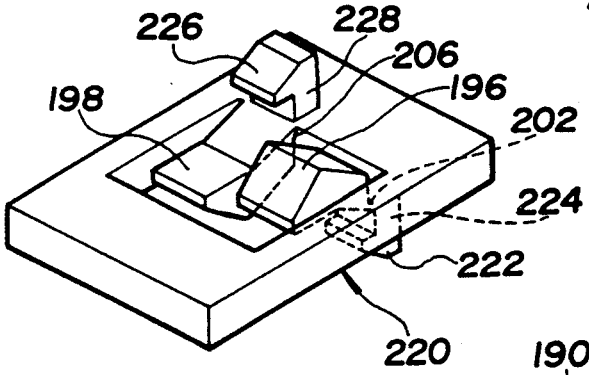
FIG. 29 is a perspective view of a push piece according to further embodiment of the invention.
Figure 31:
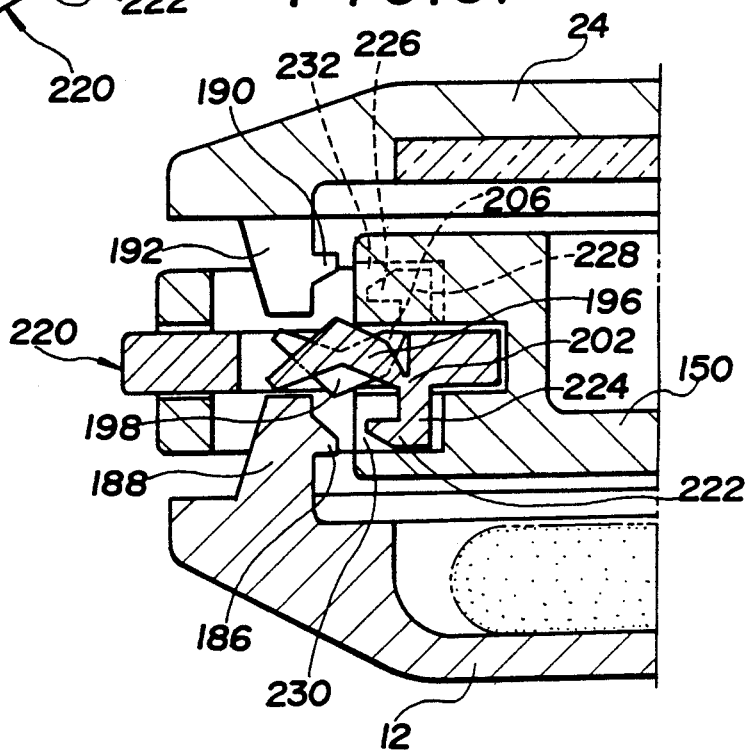

The third and fourth latch tongues may be provided on the push piece instead of on the tray, as shown in FIGS. 29 through 31. The third latch tongue 222 is formed on a first pawl 224 which extends downwardly from the rear wall of a push piece 220 adjacent the section 202, and the fourth latch tongue 226 is formed on a second pawl 228 extending upwardly adjacent the section 206. The tray 150 has first and second cavities 230 and 232 that are formed on the inner surface defining the through-hole 156 at positions corresponding to the first and second pawls 224 and 228, respectively, to permit the sliding movement thereof. With these arrangements, the inward movement of the push piece 220 separates its latch tongues 222 and 226 away from the first and second tongues 186 and 190, respectively, to release the engagements. At the same time, the first arm 196 presses down the receptacle 12 through the nose 188 while the second arm 198 presses up the cover 24 through the nose 192. As in the example of FIG. 8, the push piece 220 may be provided with resilient wings for normally urging the piece forwardly.

Although the present invention has been described with reference to preferred embodiments thereof, many modifications and alterations may be made within the spirit of the invention.

What is claimed is:

1. A vanity case comprising:

a receptacle member;

a cover member hinged with said receptacle member at a rear end thereof;

one of said receptacle member and said cover member having formed in a front portion thereof a recess;

the other of said cover member and said receptacle member having extending from a front portion thereof a nose;

latch means for maintaining said cover member in a closed position with respect to said receptacle member;

a push piece mounted for sliding movement relative to said recess, said push piece having therethrough a center opening defined by a rear wall member, said center opening being located such that when said cover member is in said closed position said nose extends into said center opening;

an arm swingably and integrally hinged to said rear wall member and extending therefrom in a direction forwardly and toward a bottom of said recess, said arm having a first surface positioned closely adjacent said nose when said cover member is in said closed position; and stationary abutment means for, upon rearward movement of said push piece, abutting against a second surface of said arm and thereby causing said arm to swing relative to said rear wall member and to move into said center opening, thus causing said arm to move said nose and release said latch means and open said cover member from said receptacle member.

2. A vanity case as claimed in claim 1, wherein said push piece comprises a plate-like body through which said center opening is formed, and wherein said push piece is slidably mounted to extend across said recess.

3. A vanity case as claimed in claim 1, wherein said arm is connected to a surface of said rear wall member facing said center opening.

4. A vanity case as claimed in claim 3, wherein said arm normally extends obliquely forwardly in such a manner that a front portion thereof is spaced from said center opening.

5. A vanity case as claimed in claim 3, wherein said arm comprises a horizontal portion and a vertical portion joined together to form an L-shape, said horizontal portion extending forwardly and said vertical portion being adjacent said abutment means.

6. A vanity case as claimed in claim 5, wherein said push piece includes a front wall and side walls surrounding a front portion, each said side wall having formed thereon a projection, and wherein side surfaces defining said recess have formed therein grooves for slidably receiving said projections.

7. A vanity case as claimed in claim 6, further comprising a slit formed in an inner surface defining said recess for accommodating the rear portion of said push piece.

8. A vanity case as claimed in claim 1, wherein said arm is connected to a surface of said rear wall member opposite said center opening, and wherein said arm comprises a base portion extending obliquely forwardly and a hook portion extending at a substantially right angle toward said center opening.

9. A vanity case as claimed in claim 1, further comprising a hole extending through a front wall defining said recess and a slit formed in an inner surface of said recess, and wherein a body of said push piece extends through said hole, across said recess and into said slit.

10. A vanity case as claimed in claim 1, wherein said latch means comprises a first latch member formed on an inner surface defining said recess and a second latch member formed on said nose to engage with said first latch member, and wherein the engagement between said latch members is released due to a pressure applied to said nose by said arm.

11. A vanity case as claimed in claim 1, wherein said latch means comprises a first latch member formed on said push piece and a second latch member formed on said nose to engage with said first latch member, and wherein the engagement between said latch members is released by rearward movement of said push piece.

12. A vanity case as claimed in claim 1, wherein said abutment means comprises an angular corner formed on an inner surface defining said recess.

13. A vanity case as claimed in claim 12, wherein said second surface of said arm of said push piece is an inclined surface closely adjacent said angular corner when said cover member is in said closed position.

14. A vanity case as claimed in claim 1, wherein said abutment means comprises a projection formed in said recess.

15. A vanity case as claimed in claim 1, further comprising a tray disposed between said receptacle member and said cover member and hinged with said receptacle member at said rear end thereof.

16. A vanity case as claimed in claim 15, wherein said tray has formed in a front end thereof a vertically extending through-hole, and wherein said push piece is mounted to said tray with said center opening aligned with said through-hole.

17. A vanity case as claimed in claim 16, wherein said nose extends through said through-hole into said recess, and said latch means comprises a first latch member formed on an inner surface defining said recess and a second latch member formed on said nose to engage with said first latch member.

18. A vanity case as claimed in claim 17, wherein said arm comprises a pair of spaced arms, and wherein said nose includes shoulders adjacent said arms when said cover member is in said closed position.

19. A vanity case as claimed in claim 17, comprising a first nose formed on said receptacle member and a second nose formed on said cover member, said first and second noses extending into said through-hole, and wherein said arm comprises a first arm adjacent an end of said first nose and a second arm adjacent an end of said second nose.

20. A vanity case as claimed in claim 19, wherein said first and second arms are arranged in side by side relation and adapted to swing in opposite directions.

21. A vanity case as claimed in claim 20, wherein said tray has a slit extending across said through-hole and wherein said push piece is slidably fitted in said slit.

22. A vanity case as claimed in claim 21, wherein said abutment means comprises a first angular corner defined between an inner surface of said through-hole and an upper surface of said slit to act on said first arm, and a second angular corner defined between an inner surface of said through-hole and a lower surface of said slit to act on said second arm.

23. A vanity case as claimed in claim 22, wherein said first arm includes an upwardly inclined surface closely adjacent said first angular corner and said second arm includes a downwardly inclined surface closely adjacent said second angular corner.

24. A vanity case as claimed in claim 19, wherein said latch means includes a first latch member formed on said first nose and a second latch member formed on said second nose.

25. A vanity case as claimed in claim 24, wherein said latch means further comprises third and fourth latch members formed on an inner surface defining said through-hole to engage with said first and second latch members, respectively.

26. A vanity case as claimed in claim 24, wherein said latch means further comprises third and fourth latch members formed on said push piece to engage with said first and second latch members, respectively, and wherein such engagements are released by rearward movement of said push plate.

27. A vanity case as claimed in claim 26, wherein said push piece further includes a downwardly extending first pawl having said third latch member and an upwardly extending second pawl having said fourth latch member.

28. A vanity case as claimed in claim 1, further comprising elastic means for urging said push piece forwardly.

29. A vanity case as claimed in claim 28, wherein said elastic means comprises a pair of resilient wings formed integrally with said push piece.

* * * * *